US009022361B2

(12) United States Patent
Ledebuhr et al.

(10) Patent No.: US 9,022,361 B2
(45) Date of Patent: May 5, 2015

(54) ROTARY ATOMIZER DRIP CONTROL METHOD AND APPARATUS

(75) Inventors: Richard Ledebuhr, Bath, MI (US); Michael H. Hetherington, Williamston, MI (US)

(73) Assignee: Ledebuhr Industries, Inc., Williamston, MI (US)

( * ) Notice: Subject to any disclaimer, the term of this patent is extended or adjusted under 35 U.S.C. 154(b) by 688 days.

(21) Appl. No.: 13/344,272

(22) Filed: Jan. 5, 2012

(65) Prior Publication Data

US 2013/0175718 A1 Jul. 11, 2013

(51) Int. Cl.
*B01F 3/04* (2006.01)
*B05B 1/00* (2006.01)

(52) U.S. Cl.
CPC ..... *B05B 1/00* (2013.01)

(58) Field of Classification Search
CPC ..... B05B 1/00
USPC ..... 261/151, 78.2, 84, 85, 88, 89, DIG. 85
See application file for complete search history.

(56) References Cited

U.S. PATENT DOCUMENTS 1,065,985 A * 7/1913 Swem ..... 261/17
1,988,076 A * 1/1935 Fleisher ..... 261/140.1
1,992,762 A * 2/1935 Pease ..... 95/219
2,537,833 A * 1/1951 Joos ..... 261/28
2,948,233 A * 8/1960 Scharfe ..... 210/416.1
3,193,261 A * 7/1965 Nesbitt ..... 261/142
3,528,781 A * 9/1970 Gelfman et al. ..... 422/169
3,552,097 A * 1/1971 Grasseler ..... 96/282
4,019,684 A 4/1977 Parkin
4,221,332 A 9/1980 Bals
4,225,084 A 9/1980 Bals
4,423,840 A 1/1984 Coeling
4,502,634 A 3/1985 Bals
4,505,430 A 3/1985 Rodgers et al.
4,619,401 A 10/1986 Hardman
4,643,357 A 2/1987 Culbertson et al.
4,684,064 A 8/1987 Kwok
4,776,520 A 10/1988 Merritt
4,795,095 A 1/1989 Shepard
4,896,834 A 1/1990 Coeling et al.
4,899,936 A 2/1990 Weinstein
4,927,081 A 5/1990 Kwok et al.
4,936,509 A 6/1990 Weinstein
4,936,510 A 6/1990 Weinstein
5,518,180 A 5/1996 Svendsen
5,704,954 A * 1/1998 Takagi ..... 96/286
5,707,009 A 1/1998 Schneider
5,947,377 A 9/1999 Hansinger et al.
5,948,324 A * 9/1999 Cook ..... 261/36.1
6,029,905 A 2/2000 van der Steur (Continued)

*Primary Examiner* — Charles Bushey
(74) *Attorney, Agent, or Firm* — Gifford, Krass, Sprinkle, Anderson & Citkowski, P.C.

(57) ABSTRACT

A system to control drips from rotary atomizers without the use of recirculation pumps or drain tubes. The drips are collected in a catch basin suspended under the atomizer and reintroduced to the rotary atomizer by one of three methods; a mechanical pumping action from a cone or impeller extending from the rotating part of the atomizer, a suction from a Venturi section built into the fluid delivery tube, or by aspirating the fluid back into the atomizer by using the exhaust air from an air motor. Additionally, to prevent bacterial growth and to completely eliminate any moisture after shutdown, a heating element can be incorporated into the catch basin to sterilize and evaporate any excess fluid.

15 Claims, 4 Drawing Sheets

(56) References Cited

U.S. PATENT DOCUMENTS

| | | | | |
|---|---|---|---|---|
| 6,053,428 | A | 4/2000 | Van Der Steur | |
| 6,341,734 | B1 | 1/2002 | Van Der Steur | |
| 6,551,402 | B1 | 4/2003 | Renyer et al. | |
| 6,565,021 | B2 | 5/2003 | Borner et al. | |
| 6,578,779 | B2 | 6/2003 | Dion | |
| 6,708,908 | B2 | 3/2004 | Heldt et al. | |
| 6,783,082 | B2 | 8/2004 | Renyer et al. | |
| 6,972,052 | B2 | 12/2005 | Krumma et al. | |
| 7,080,794 | B2 | 7/2006 | Baumann et al. | |
| 7,387,664 | B2 * | 6/2008 | Kim | 96/270 |
| 8,141,797 | B2 | 3/2012 | Vetter et al. | |
| 2011/0114744 | A1 * | 5/2011 | Ricciardi et al. | 239/4 |

* cited by examiner

ROTARY ATOMIZER DRIP CONTROL METHOD AND APPARATUS

FIELD OF THE INVENTION

This invention relates generally to rotary atomizers and, in particular, to a system and method to control drips from rotary atomizers without the use of recirculation pumps or drain tubes.

BACKGROUND OF THE INVENTION

Rotary atomizers are an effective way to create a fine mist of fluid. This mist can be used for humidification and dust control. One of the difficulties with using rotary atomizers for humidification in exposed areas is the danger of the rotating components of the atomizer. When guards, shrouds or diffusers are attached to, or around, the atomizer some of the fluid will coalesce on these structures and form drips. Traditionally, drip pans with recirculation pumps, or drains, have been used to catch drips and dispose of the excess fluid.

SUMMARY OF THE INVENTION

This invention improves upon the existing art by capturing excess fluid produced by a rotary atomizer and reintroducing the liquid to the atomizer in a 'passive' manner—that is, without the use of additional electrical or mechanical pumps. The apparatus, configured for use with a rotary atomizer of the type that produces a fine mist through centrifugal ejection of a liquid from a feed line through a rotating component, broadly comprises a primary catch basin supported beneath the atomizer to collect dripping liquid and a system for recirculating the collected liquid back into the atomizer for dispersion without the use of a separate powered pump.

The atomizer typically includes a guard, shroud or diffuser around the rotating component upon which the mist coalesces to form drips and, in the preferred embodiments, the primary catch basin has a diameter larger than the guard, shroud or diffuser.

The system for recirculating the collected liquid back into the atomizer may include an impeller extending downwardly from the rotating component of the atomizer, the impeller having a distal opening extending into the liquid collected by the primary catch basin, whereby the liquid is drawn up and into the rotating component due to negative pressure and surface tension caused by the centrifugal ejection of the atomizer's rotating component. In the preferred embodiment the impeller is cone-shaped with a smaller distal end extending into the liquid to be collected. One or more holes may be formed in the bottom of the rotating component of the atomizer to reintroduce the collected liquid into the atomizer's rotating component.

A secondary catch basin may be supported beneath the catch basin, with an orifice in the bottom of the primary catch basin to drain any residual liquid from the primary catch basin into the secondary catch basin following shut-down of the atomizer. The orifice also assists in blowing the collected liquid into the rotating component of the atomized to improve recovery.

In accordance with an alternative embodiment, the rotating component is driven by an air supply producing a source of waste exhaust air. The primary catch basin includes a lower orifice, and the system for recirculating the collected liquid back into the atomizer includes a conduit from the source of waste exhaust air to the orifice below the primary catch basin causing the collected liquid to spray into the rotating component. As a further alternative, the liquid feed line includes a constriction causing a negative pressure due to the Venturi effect. The primary catch basin includes a lower orifice, and the system for recirculating the collected liquid back into the atomizer includes a conduit from the constriction to the orifice below the primary catch basin drawing the collected liquid into the liquid feed line.

DETAILED DESCRIPTION OF THE INVENTION

This invention eliminates many problems with using rotary atomizers used for humidification, or where drips from the support and guard structure are undesirable. Using a catch basin underneath the atomizer to collect fluid that has coalesced on the structure, the collected fluid is reintroduced to the atomizer though different embodiments which will now be described in detail.

Figure 1:
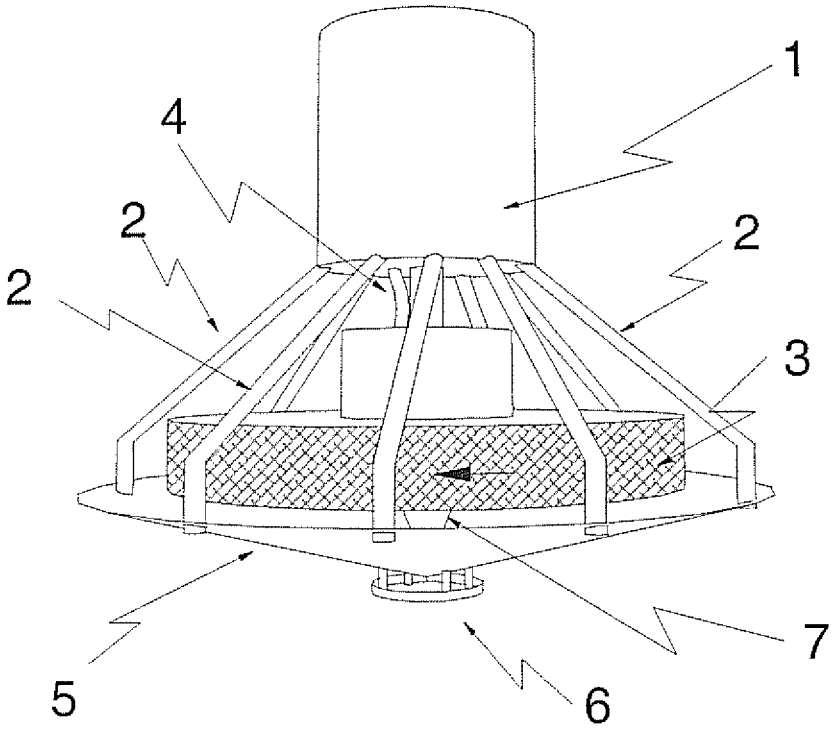
FIG. 1 is a simplified perspective view of a cage rotary atomizer with guards and a catch basin showing the mechanical impeller embodiment of the invention.

FIG. 1 is a simplified, perspective view of a rotary atomizer with guards and a catch basin constructed in accordance with the invention. This figure depicts the preferred embodiment of the invention which utilizes a mechanical impeller. The atomizer shown employs a rotating screen or mesh 3 sometimes called a "cage" rotary atomizer because of its superior ability to create fine droplets for humidification and dust control. However, the invention in all its embodiments could be applied to any rotary atomizer, including those employing rotating disks, sintered material, brushes or other known implementations.

The atomizer is driven by a motor 1 which could be electric, hydraulic or air-operated. This motor rotates the atomizing disks or mesh 3. The fluid is first introduced to the atomizer by a feed tube 4. As the fluid leaves the rotating parts of the atomizer some of it will impinge on the guard and support structures 2 where it will coalesces and form drips that will move down the structures by gravity into the catch basin 5. The catch basin may be cone-shaped, and the captured drips collect at the bottom where they may be reintroduced into the atomizer by the apparatus and methods described. A secondary catch basin 6 may be attached to the primary basin 5 to capture drips from the drain hole in the primary basin. This secondary basin may be heated to evaporate any liquid which might escape the primary recirculation methods described.

Figure 2:
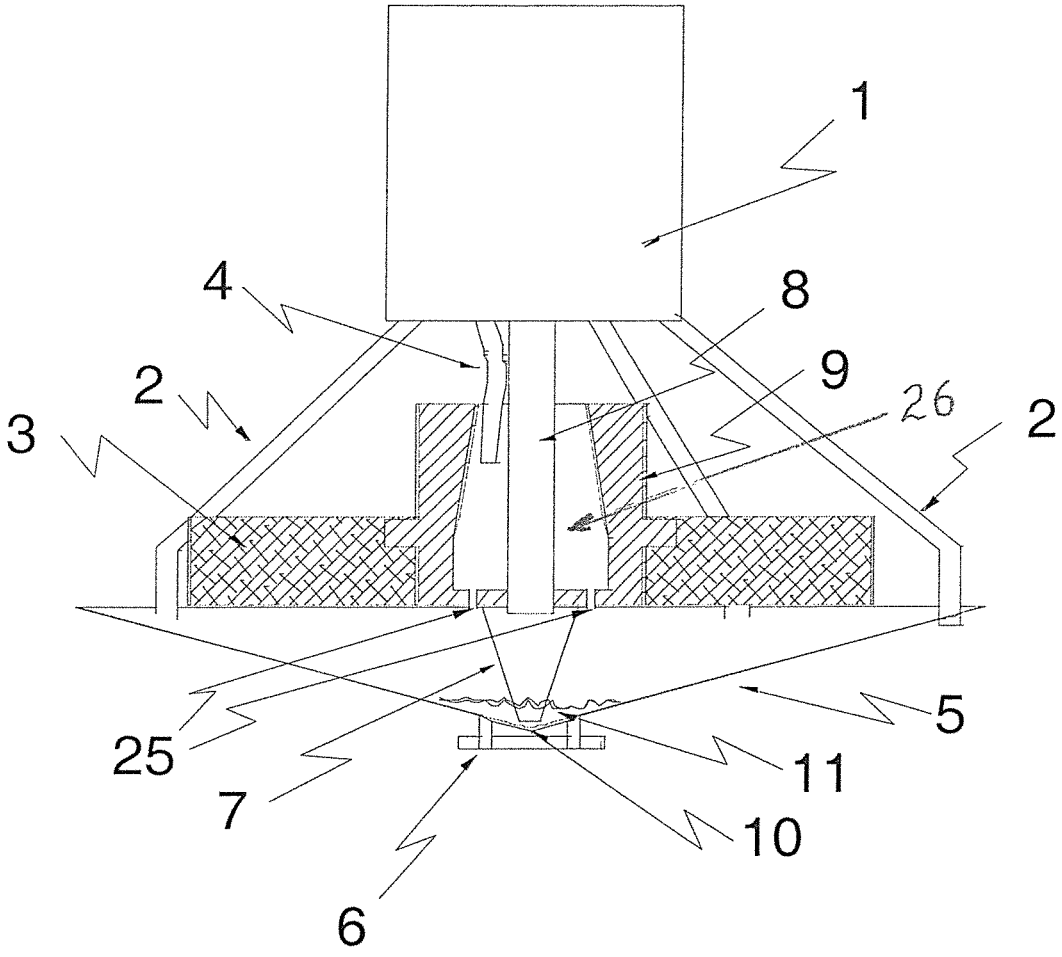
FIG. 2 is a simplified section cut illustrating the attachment of an impeller cone to a motor shaft, facilitating co-rotation with a mesh basket mounting hub to capture collected excess fluid.

At the bottom of the catch basin, and attached to the rotating component is a small conical impeller 7 that draws the excess fluid back on the lower part of the atomizer or back into the rotary component, a mesh basket in this case. FIG. 2 is a simplified section cut showing the attachment of the impeller cone 7 to the motor shaft 8, enabling it to rotate with the mesh basket mounting hub 9, the distal end of the cone extending into the captured excess fluid. The fluid will move up the conical shape of the impeller and onto the bottom of the rotating disk. The excess fluid is then ejected from the surface of the disk. If small holes 25 are placed in the hub or lower plate of a cage type atomizer, the fluid will be drawn into a centrally hollow volume 26 of the hub through the small holes 25 due to the negative pressure created by the centrifugal ejection of liquid from the hub. Holes may also be placed on the inside of the cone. In any case, due to the negative pressure and/or surface tension, the collected liquid moves up the sides of the structure 7 where it is reintroduced and atomized.

FIG. 2 further shows the area where the captured liquid 11 will collect, allowing it to contact the impeller 7. A small drain hole 10 may be placed in the catch basin 5 to allow drainage after the atomizer is shut down. The hole 10 also assists in blowing the fluid onto the impeller while the atomizer is operational.

Figure 3:
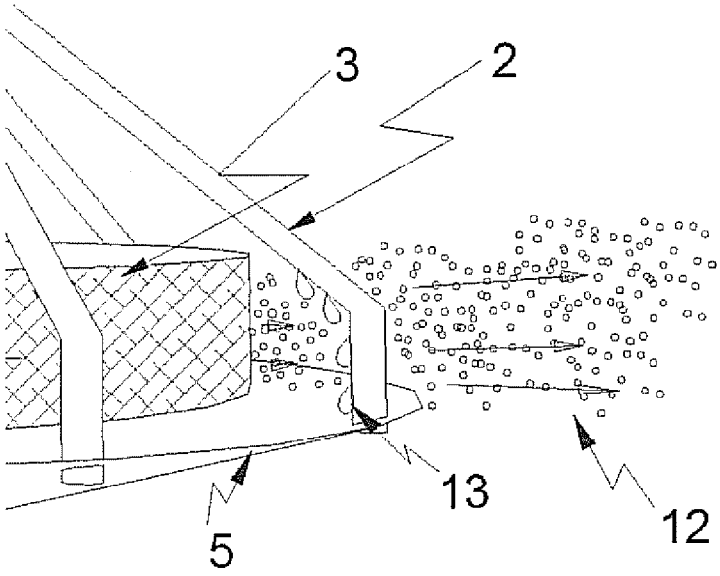
FIG. 3 is a close-up view of support and guard structures and atomized fluid as it coalesces on the structure to form drops that travel down the structure and into a primary catch basin.

FIG. 3 shows a close view of the support and guard structures 2 and the atomized fluid 12 as it coalesces on the structure and form drops 13 that travel down the structure by gravity, into the primary catch basin 5.

Figure 4:
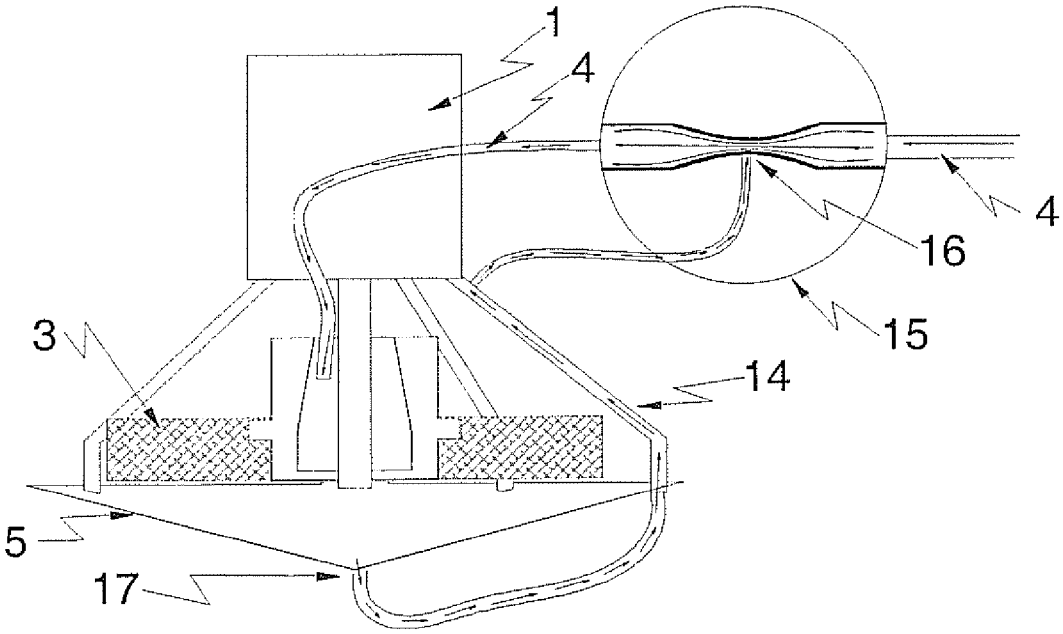
FIG. 4 is a simplified section cut of an embodiment wherein the captured drops are removed from the bottom of a catch basin by a tube attached to a constricted section of the primary liquid feed line developing a negative pressure due to the Venturi effect.

FIG. 4 shows a simplified section cut of an embodiment where the captured drops are removed from the bottom of the catch basin 5 by a tube 17 coupled to a constricted section 16 (shown in the detail view 15) of the primary liquid feed 4. The Venturi effect created by this constriction, and the energy of the flowing primary fluid causes a negative pressure that removes excess liquid from the catch basin. The excess fluid can be conducted from the bottom of the catch basin 5 through a tube attached or inside the support 14.

Figure 5:
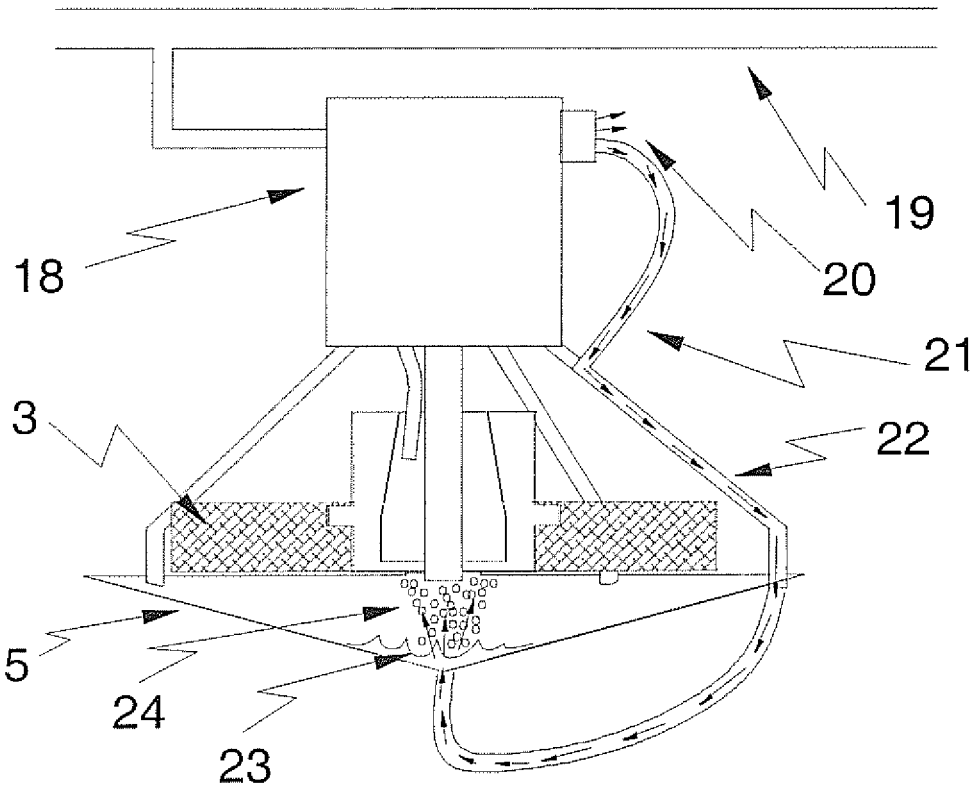
FIG. 5 is a simplified section cut of an embodiment where the captured liquid is propelled onto or back into the atomizer through the use of the waste exhaust air.

FIG. 5 shows a simplified section cut of an embodiment where the captured liquid is propelled onto or back into the atomizer through the use of the waste exhaust air. In this embodiment the motor 18 is an air-motor powered from the installed air system 19. Some or all of the waste exhaust air 20 is conducted by a tube 21 and connected or inside the support structure 22 to the bottom of the catch basin where it is released through an orifice into the collected liquid 23. The air and liquid are ejected on the bottom of the atomizer 24.

A heating element may be used to sterilize and evaporate any excess fluid. This heating element may be attached to the primary catch basin 5 or to a secondary catch basin 6. In either case, the thermal mass and temperature is maintained high enough to evaporate or serialize excess water in the event of an inadvertent shut down where power is lost unexpectedly. This heating element may heat a metal plate or similar structure having a thermal mass great enough to evaporate any drips in the event the atomizer is inadvertently shut down because of unintentional loss of power.

The invention claimed is:

1. Apparatus for eliminating drips from a rotary atomizer of the type that produces a fine mist through centrifugal ejection of a liquid from a feed line into a central, hollow hub of a rotating component, the apparatus comprising:

a primary catch basin supported beneath the atomizer to collect dripping liquid; and a system for recirculating the collected liquid back into the central, hollow hub of the rotating component for dispersion without the use of a separate pump.

2. The apparatus of claim 1, wherein the system for recirculating the collected liquid back into the atomizer includes:

an impeller extending downwardly from the rotating component of the atomizer, the impeller having a distal opening extending into the liquid collected by the primary catch basin, whereby the liquid is drawn up and into the central, hollow hub of the rotating component due to negative pressure or surface tension caused by the centrifugal ejection of the atomizer's rotating component.

3. The apparatus of claim 1, wherein the system for recirculating the collected liquid back into the atomizer includes:

an impeller extending downwardly from the rotating component of the atomizer, the impeller having a distal opening extending into the liquid collected by the primary catch basin, whereby the liquid is drawn up and into the central, hollow hub of the rotating component due to negative pressure caused by the centrifugal ejection of the atomizer's rotating component;

a secondary catch basin supported beneath the catch basin; and an orifice in the bottom of the primary catch basin to blow the collected liquid into the rotating component and to drain any residual liquid from the primary catch basin into the secondary catch basin following shut-down of the atomizer.

4. The apparatus of claim 1, wherein the system for recirculating the collected liquid back into the atomizer includes:

one or more holes formed in the bottom of the central, hollow hub of the rotating component of the atomizer to generate a negative pressure caused by the centrifugal ejection of the rotating component;

an impeller extending downwardly from the rotating component, the impeller having a distal opening extending into the liquid collected by the primary catch basin, whereby the liquid is drawn up and into the central, hollow hub of the rotating component due to the negative pressure.

5. The apparatus of claim 1, wherein the system for recirculating the collected liquid back into the atomizer includes:

one or more holes formed in the bottom of the central, hollow hub of the rotating component of the atomizer to generate a negative pressure caused by the centrifugal ejection of the rotating component;

an impeller extending downwardly from the rotating component, the impeller having a distal opening extending into the liquid collected by the primary catch basin, whereby the liquid is drawn up and into the central, hollow hub of the rotating component due to the negative pressure or surface tension;

a secondary catch basin supported beneath the catch basin; and an orifice in the bottom of the primary catch basin to blow the collected liquid into the rotating component and to drain any residual liquid from the primary catch basin into the secondary catch basin following shut-down of the atomizer.

6. The apparatus of claim 1, wherein:

the rotating component is driven by an air supply producing a source of waste exhaust air;

the primary catch basin includes a lower orifice; and the system for recirculating the collected liquid back into the atomizer includes a conduit from the source of waste exhaust air to the orifice below the primary catch basin causing the collected liquid to spray into the rotating component.

7. The apparatus of claim 1, further including:

a constriction in the liquid feed line causing a negative pressure due to the Venturi effect;

a lower orifice in the primary catch basin; and wherein the system for recirculating the collected liquid back into the atomizer includes a conduit from the from constriction to the orifice below the primary catch basin drawing the collected liquid into the liquid feed line.

8. The apparatus of claim 1, wherein:

the atomizer includes a guard, shroud or diffuser around the rotating component upon which the mist coalesces to form drips; and the primary catch basin has a diameter larger than the guard, shroud or diffuser.

9. The apparatus of claim 1, further including a heater to sterilize the collected liquid.

10. The apparatus of claim 1, wherein the rotating component includes a screen or mesh forming a cage or basket.

11. The apparatus of claim 2, wherein the impeller is cone shaped with a smaller distal end extending in to the liquid to be collected.

12. The apparatus of claim 3, wherein the impeller is cone shaped with a smaller distal end extending in to the liquid to be collected.

13. The apparatus of claim 4, wherein the impeller is cone shaped with a smaller distal end extending in to the liquid to be collected.

14. The apparatus of claim 5, wherein the impeller is cone shaped with a smaller distal end extending in to the liquid to be collected.

15. Apparatus for eliminating drips from a rotary atomizer of the type that produces a fine mist through centrifugal ejection of a liquid from a feed line into a central, hollow hub of a rotating component, the atomizer including a guard, shroud or diffuser around the rotating component upon which the mist coalesces to form drips, the apparatus comprising:

a primary catch basin supported beneath the atomizer to collect the drips, the primary catch basin having a diameter larger than the guard, shroud or diffuser; and a system for recirculating the collected liquid back into the central, hollow hub of the atomizer for dispersion without the use of a separate, electrically powered pump.

* * * * *

UNITED STATES PATENT AND TRADEMARK OFFICE

CERTIFICATE OF CORRECTION

PATENT NO. : 9,022,361 B2
APPLICATION NO. : 13/344272
DATED : May 5, 2015
INVENTOR(S) : Richard Ledebuhr et al.

It is certified that error appears in the above-identified patent and that said Letters Patent is hereby corrected as shown below:

In the Claims

Column 4, line 67: Delete "from" (second occurrence).

Signed and Sealed this
Eighteenth Day of August, 2015

Michelle K. Lee

Michelle K. Lee
*Director of the United States Patent and Trademark Office*